US008113923B2

(12) United States Patent
Reinhardt

(10) Patent No.: US 8,113,923 B2
(45) Date of Patent: Feb. 14, 2012

(54) CHAMFERING TOOL AND DRUM SANDER

(76) Inventor: Frederick Carl Reinhardt, Amherst Junction, WI (US)

( * ) Notice: Subject to any disclaimer, the term of this patent is extended or adjusted under 35 U.S.C. 154(b) by 19 days.

(21) Appl. No.: 12/695,652

(22) Filed: Jan. 28, 2010

(65) Prior Publication Data

US 2010/0197212 A1 Aug. 5, 2010

Related U.S. Application Data

(60) Provisional application No. 61/206,874, filed on Feb. 5, 2009.

(51) Int. Cl.
*B24B 23/00* (2006.01)

(52) U.S. Cl. ..... 451/490; 451/496

(58) Field of Classification Search ..... 451/490, 451/496, 502, 508, 541, 462, 430, 440
See application file for complete search history.

(56) References Cited

U.S. PATENT DOCUMENTS

| | | | | |
|---|---|---|---|---|
| 2,485,295 | A * | 10/1949 | Larson | 206/447 |
| 3,877,185 | A * | 4/1975 | Wells | 451/496 |
| 4,001,982 | A * | 1/1977 | Griffin et al. | 451/552 |
| 4,067,149 | A * | 1/1978 | Ali et al. | 451/496 |
| 7,267,125 | B2 * | 9/2007 | Nevakshonoff | 132/73.6 |
| 7,354,336 | B1 * | 4/2008 | Lalancette et al. | 451/28 |

* cited by examiner

*Primary Examiner* — Robert Rose
(74) *Attorney, Agent, or Firm* — Brannen Law Office, LLC

(57) ABSTRACT

A device for chamfering and sanding is disclosed. The device comprises a cylindrical body containing a hollow cone lined with sandpaper attached to the surface of the cone with adhesive. Two corners of the sandpaper are inserted respectively into two slots contained in the sidewall of the cone to further hold the sandpaper in place. The device comprises a shaft attached to the bottom of the device for clutching by a drill press or a three jaw chuck. As the device rotates, objects that require bevelling or sanding are inserted into the cone and pressed against the sandpaper. A sandpaper sleeve is attached to the outer surface of the cylindrical body that may be used for sanding and smoothing.

2 Claims, 6 Drawing Sheets

CHAMFERING TOOL AND DRUM SANDER

RELATED APPLICATIONS

This application claims priority from provisional application No. 61/206,874 filed on Feb. 5, 2009.

FIELD OF THE INVENTION

The present invention relates to a tool for chamfering and sanding objects that require rounding, bevelling or sanding including but not limited to wood, metal and plastic.

BACKGROUND OF THE INVENTION

Various objects such as metal and plastic tools, furniture, wood dowels and pipes, require shaping, smoothing and finishing as they are assembled. The present invention provides a convenient tool that can be used for chamfering and sanding in a drill press or a three-jaw chuck.

SUMMARY OF THE PRESENT INVENTION

In an aspect of the present invention, a device for chamfering and sanding comprises: a cylindrical body having an open circular top and a closed bottom with the cylindrical body having a hollow conical interior, the conical interior defining an interior surface, and with the conical interior also defining an outside diameter and an inside diameter, wherein a difference between the outside diameter and inside diameter defines a sidewall; a shaft attached to the bottom of the cylindrical body; a first longitudinal slot in the side wall; and a second longitudinal slot in the sidewall.

These and other features, aspects and advantages of the present invention will become better understood with reference to the following drawings, description and claims.

DETAILED DESCRIPTION OF THE DRAWINGS

In an embodiment of the present invention, a tool for chamfering and sanding comprises a cylindrical body about 2.00 inches long, having a circular open top and a round shaped closed bottom. The cylindrical body contains a hollow cone. The circular open top has an inside diameter of about 1.25 inches and an outside diameter of about 1.5 inches resulting in a wall thickness at the open top edge of about 0.125". The hollow cone starts at the open top and is disposed inside the cylinder to a depth of about 1.375 inches in a manner that the angle between the cone center line and the cone side walls ranges from about 22 degrees to about 24 degrees. The cone centerline is defined here as the line spanning from the tip of the cone and crossing the center of the circular open top. The preferred material for the device is plastic; however metal and wood also fall within the scope of the present invention.

A cylindrical shaft having a diameter of about 0.375 inches and a length of about 1.5 inches is threaded through the center of the round shape closed bottom to a depth of about 0.5 inches, stopping short of the tip of the hollow cone. The sidewall of the hollow cone contains two longitudinal slots about 0.078 inches wide that cut across the cone and the cylindrical body. As such, the width of each longitudinal slot varies across the length of the cylindrical body increasing in width as it moves toward the bottom. In an embodiment of the present invention, the two slots are diametrically opposed to each other. The hollow cone surface is lined with an abrasive paper, most typically 60 or 80-grit sandpaper. The sandpaper may be attached to the hollow cone surface using a pressure sensitive adhesive coated onto the backside of the sandpaper sheet. To further help keep the sandpaper in place, a corner of the sandpaper is pulled through each slot. For this purpose, a size 2.25" wide and 3.25" long sandpaper strip with pressure sensitive backing folded in half may be pressed into the cone in a way that the corners are tucked into the slot for a stronger hold. Any excess sandpaper protruding outside the cylinder surface is trimmed off. In an embodiment of the present invention a sandpaper sleeve is slipped onto the outside surface of the cylinder. The sleeve may have a diameter of about 1.5 inches and a length of about 1.5 inches. Adhesive may be used to attach the sleeve to the cylinder surface. The sandpaper on the sleeve may have a 60 or 80-grit and may be used for sanding the surfaces of the objects that have been previously chamfered or the surfaces of the objects that require smoothing.

Figure 1:
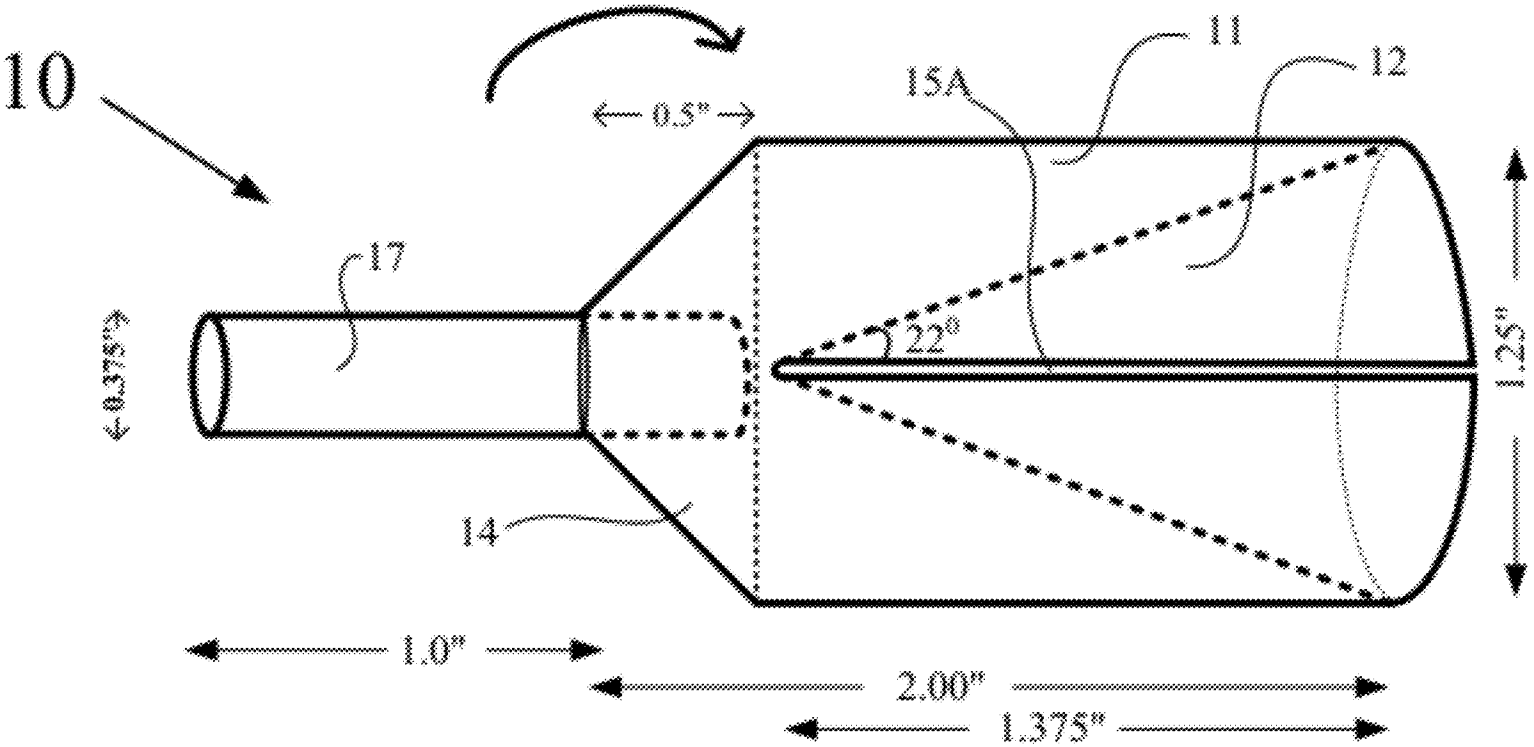
FIG. 1 is a cross sectional side view of the device according to an embodiment of the present invention.
Figure 2:
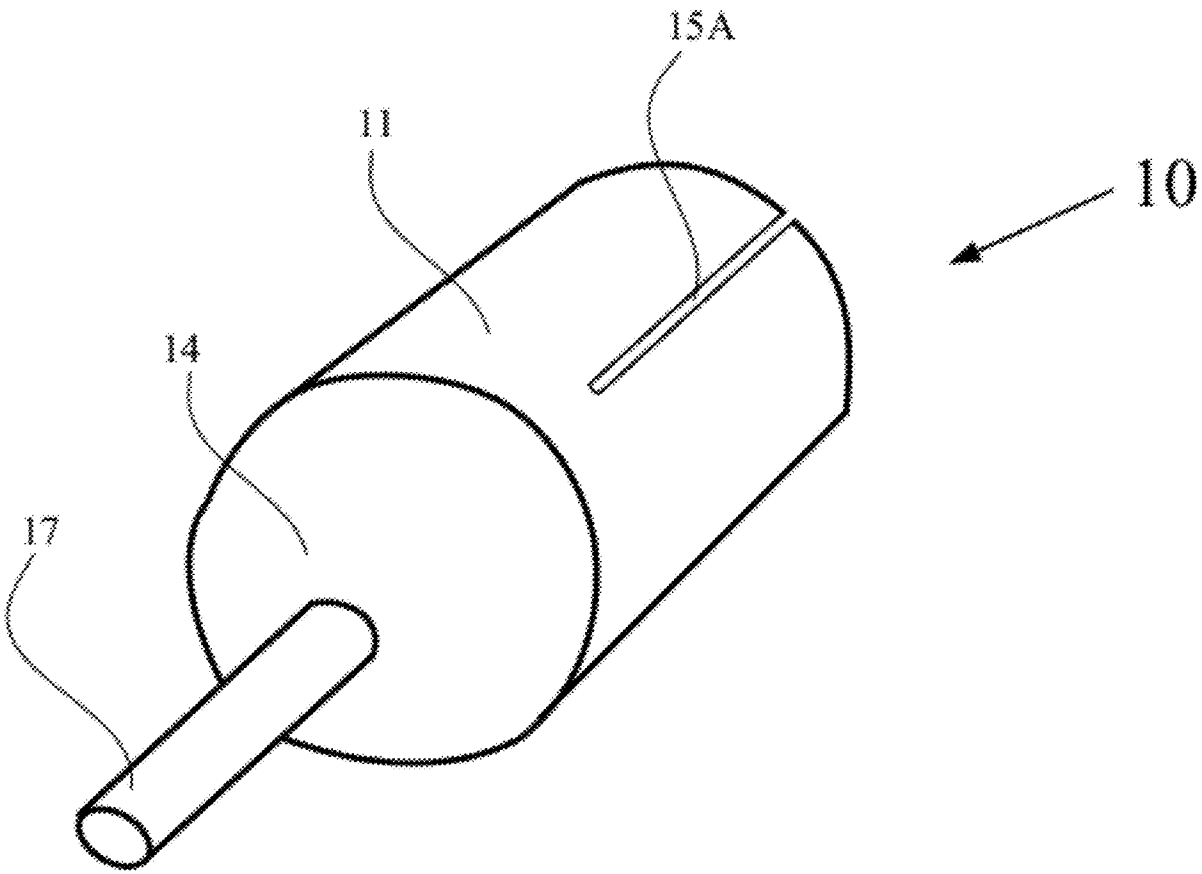
FIG. 2 is a bottom top view of the device according to an embodiment of the present invention.
Figure 3:
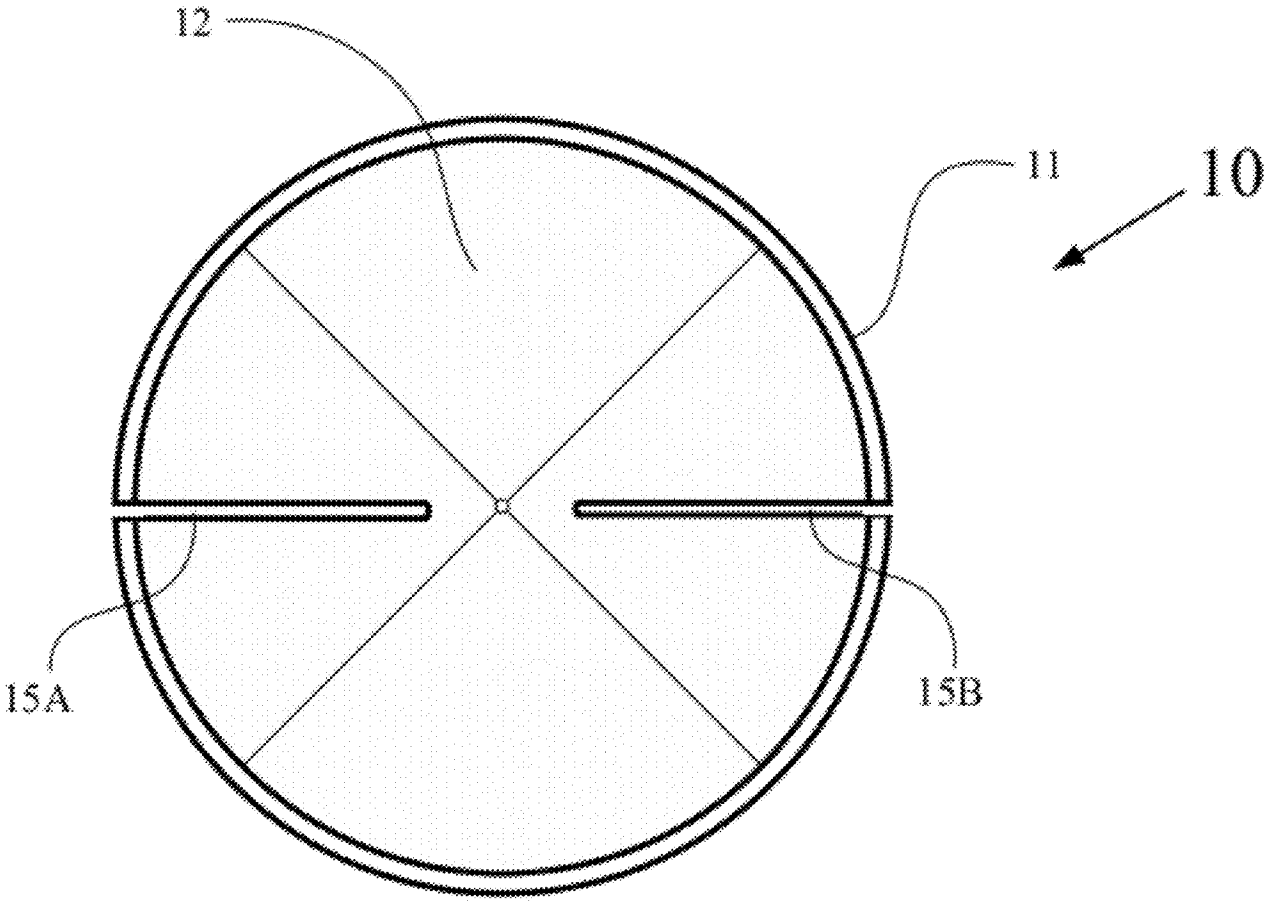
FIG. 3 is a top view of the device according to an embodiment of the present invention.
Figure 4:
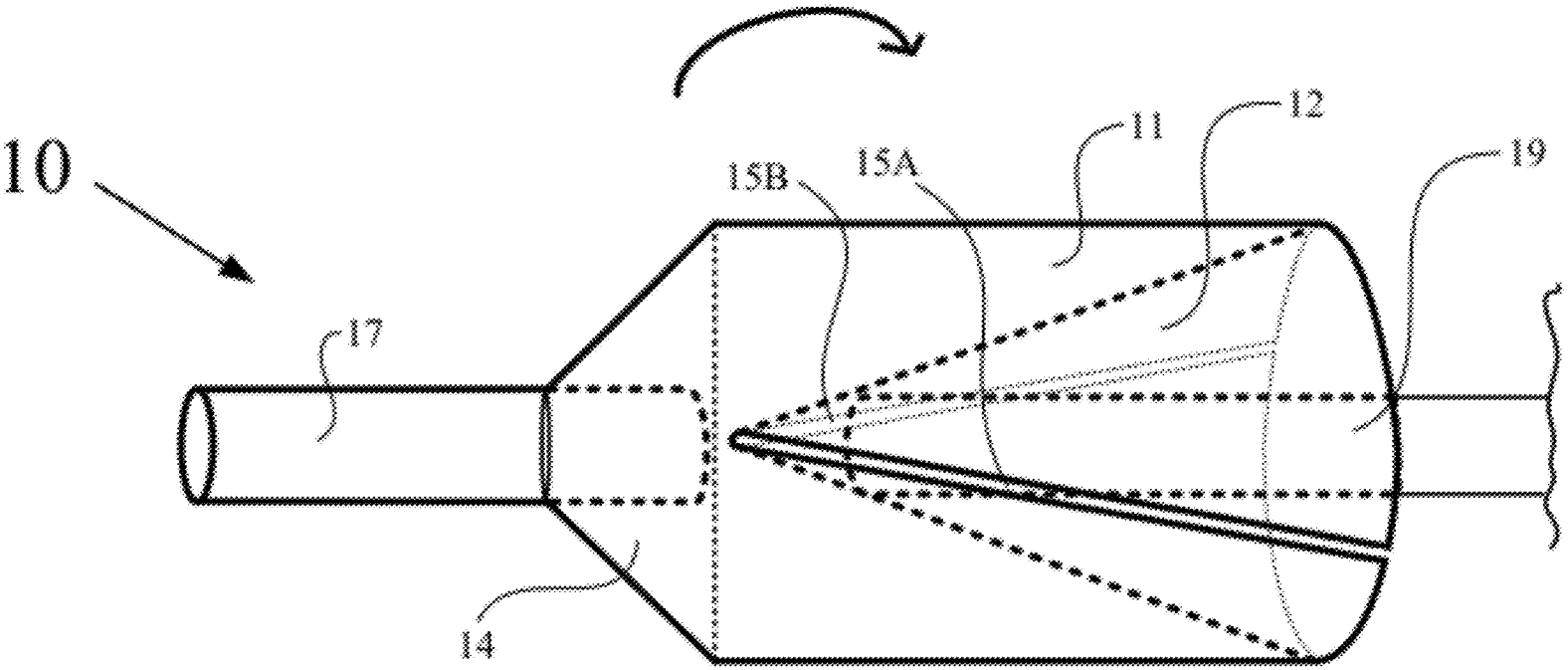
FIG. 4 is a cross sectional side view of the device in a use configuration according to an embodiment of the present invention.
Figure 5:
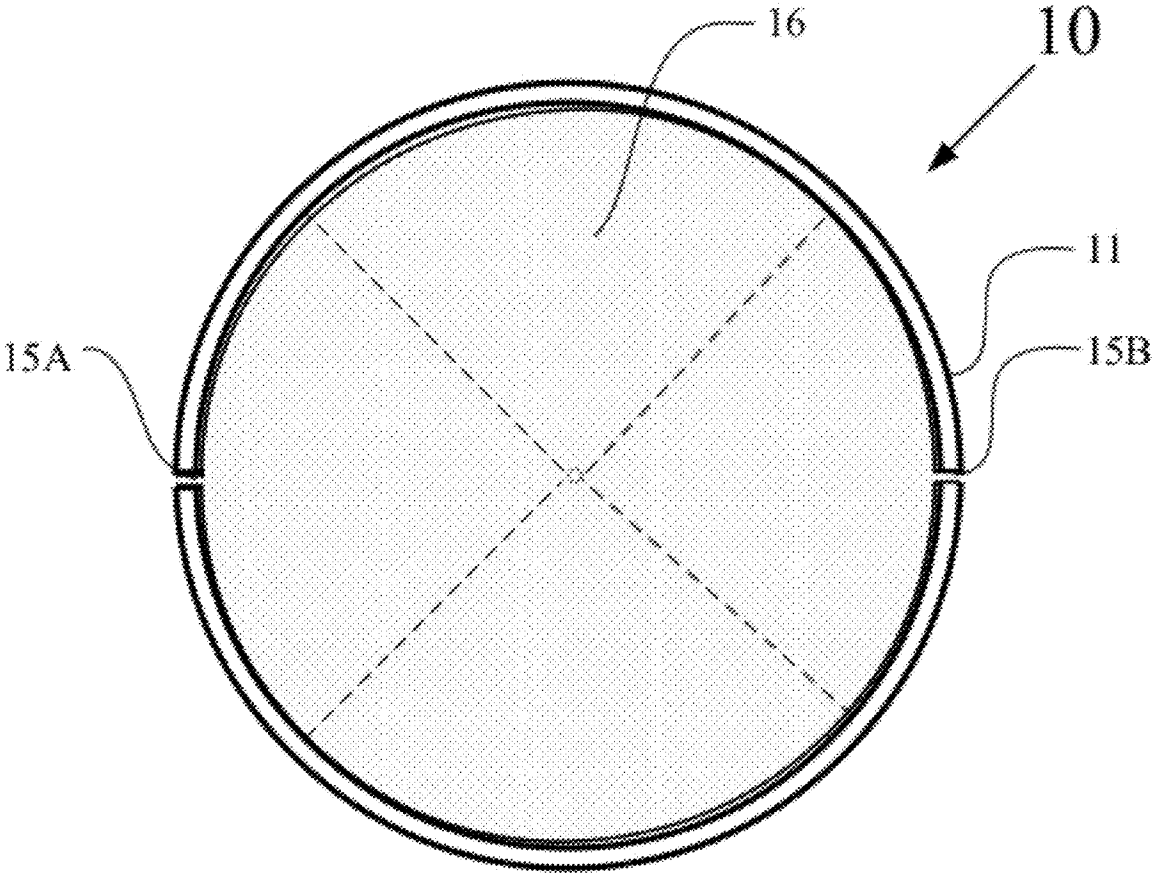
FIG. 5 is a top view of the device in a use configuration according to an embodiment of the present invention.
Figure 6:
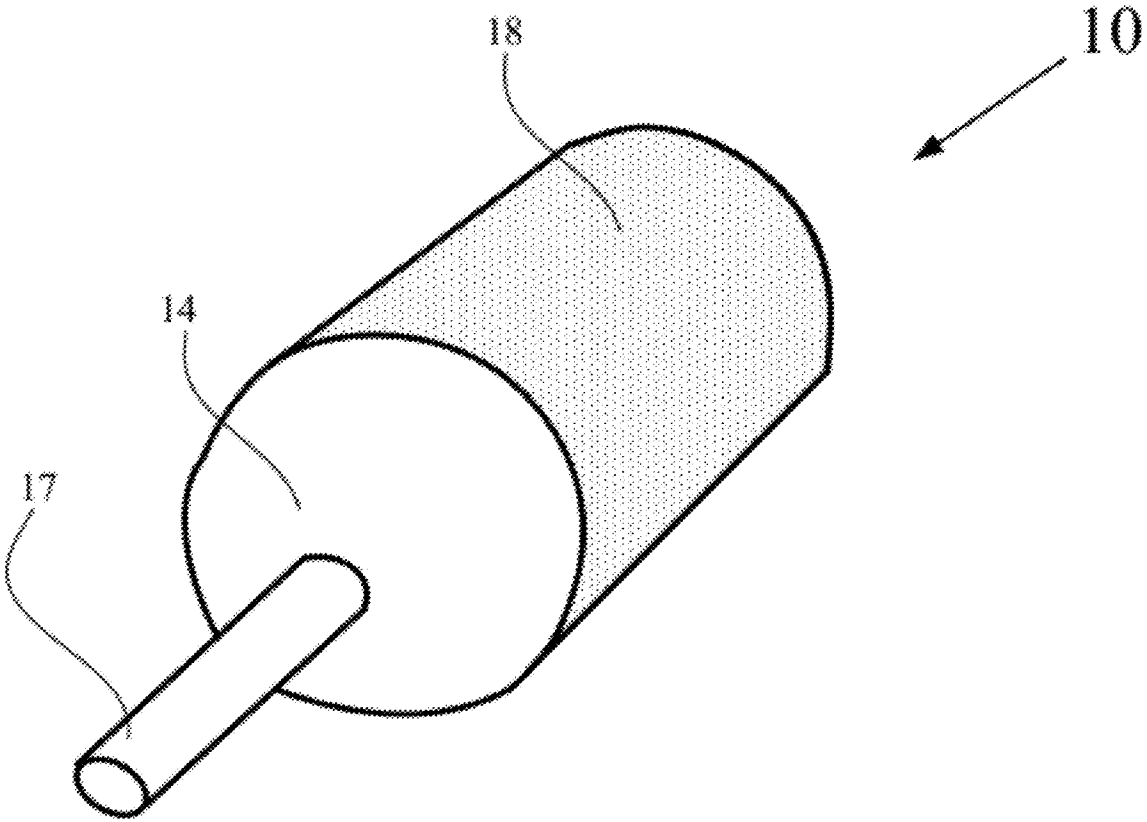
FIG. 6 is a bottom top view of the device containing an abrasive sheet according to an embodiment of the present invention.

The shaft of the device may be placed in a drill press or a three jaw chuck and rotated at variable speeds. The object requiring bevelling and/or sanding is inserted into the cone and pressed against the sandpaper as the sandpaper rotates with the device. Examples include the cut end of a wood dowel, a pipe and a rod. The device 10 is depicted in FIGS. 1-5. Shown are the cylindrical body 11 and the hollow cone 12 contained inside the cylindrical body 11. A shaft 17 is attached to the closed bottom 14. The side wall of the hollow cone comprises two slots 15A and 15B through which the sandpaper 16 is inserted for a stronger hold. FIG. 4 shows an object 19 being chamfered inside the hollow cone 12. FIG. 6 shows the sandpaper sleeve 18 wrapped onto the outside surface of the cylinder. After the object 19 is chamfered, it may be placed against the sandpaper sleeve 18 for sanding and smoothing.

I claim:

1. In combination:

a device comprising:

body, said body having a cylindrical outer profile defining an exterior surface and a conical interior defining an interior surface with an internal surface area; and a shaft attached to said body, wherein said body has a first slot and a second slot through said body and being open to said interior surface and to said exterior surface, said body being limited to having only said first slot and said second slot, said first slot and said second slot being located equidistant around the interior surface of said body to bisect said body into two equally sized parts; and an article that is generally flat, has a rectangular perimeter and has a sanding medium on one of a first side and a second side, wherein said article is folded in half whereby the sanding medium is inwardly facing;

wherein:

said body receives sanding medium within said first slot and said second slot;

said article takes a conical shape within said conical interior;

said second side of said article completely covers said interior surface of said body to peripherally continuously expose and support a conically oriented amount of sanding medium, and said article passes through said first slot and said second slot whereby said article is symmetrically held within said body to balance the weight on said body as said body rotates.

2. The combination of claim 1 wherein said second side of said article has a pressure sensitive adhesive affixed thereto to secure said second side of said article to said interior surface of said body.

* * * * *